US012758001B2

(12) United States Patent
Ni

(10) Patent No.: US 12,758,001 B2
(45) Date of Patent: Oct. 13, 2026

(54) BEVERAGE CONTAINER WITH FOLDABLE HANDLE

(71) Applicant: Shanghai Yuhao Household Appliance Manufacturing Co., Ltd., Shanghai (CN)

(72) Inventor: Zhenming Ni, San Marino, CA (US)

( * ) Notice: Subject to any disclaimer, the term of this patent is extended or adjusted under 35 U.S.C. 154(b) by 170 days.

(21) Appl. No.: 18/422,020

(22) Filed: Jan. 25, 2024

(65) Prior Publication Data

US 2025/0185793 A1 Jun. 12, 2025

(30) Foreign Application Priority Data

Dec. 8, 2023 (CN) ..... 202323354401.0

(51) Int. Cl.
*A45F 3/18* (2006.01)
*B65D 47/06* (2006.01)

(52) U.S. Cl.
CPC ..... *A45F 3/18* (2013.01); *B65D 47/065* (2013.01)

(58) Field of Classification Search
CPC ..... A45F 3/18; A47G 19/22; A47G 19/2205; A47G 19/2255; A47G 23/0208; A47G 23/0216; A47G 23/0266; A47J 36/34; A47J 45/078; B65D 23/10; B65D 25/2835; B65D 25/32; B65D 47/065
USPC ..... 224/148.7
See application file for complete search history.

(56) References Cited

FOREIGN PATENT DOCUMENTS

KR 20090011995 U * 11/2009 ..... A47J 45/061

OTHER PUBLICATIONS

KR-20090011995-U Translation, Nov. 26, 2009 (Year: 2009).*

* cited by examiner

*Primary Examiner* — Nathan J Newhouse
*Assistant Examiner* — Matthew T Theis
(74) *Attorney, Agent, or Firm* — Tsz Lung Yeung

(57) ABSTRACT

A beverage container includes a container body, a handle connector provided at an outer surface of the container body, a foldable hand pivotally coupled at the handle connector to pivotally move between a folded position and an unfolded position, and a locking button slidably coupled at the foldable handle between a locked position and an unlocked position. The locking button has a locking latch extended toward the connector body to selectively engage with a first locking groove of the handle connector. When the locking button is actuated to disengage the locking latch with the first locking groove, the foldable handle is unlocked and allowed to move between the folded position and the unfolded position. When the locking button is actuated to engage the locking latch with the first locking groove, the foldable handle is locked at the unfolded position.

13 Claims, 7 Drawing Sheets

BEVERAGE CONTAINER WITH FOLDABLE HANDLE

BACKGROUND OF THE PRESENT INVENTION

Field of Invention

The present invention relates to a beverage container, and more particularly to a beverage container with a foldable handle, wherein the foldable handle is adapted to fold between an unfolded position for a user to carry the beverage container and a folded position for easily storage.

Description of Related Arts

It has been known in the prior art to provide beverage containers, such as a vacuum cup, which are adapted to retain the beverage at a predetermined temperature for a period of time. For example, office workers and students often carry the beverage containers at home, office, and classroom in order to drink the beverage at an appropriate temperature. Therefore, the beverage containers must have the advantages of good thermal insulation ability, light weight, high strength, hygienic and convenient use. As a result, the demand of thermal beverage containers is gradually increasing.

Most beverage containers do not include a handle, such that the users must directly hold the containers to drink the beverage therein. If the containers do not have any thermal insulation ability, the heat or cold from hot or cold beverages will directly be transmitted through the container wall to the user's hand, causing discomfort to the user's hand. Some improved beverage containers include a handle to make the containers more convenient for carrying by hand. Since the handle is transversely protruded from the container cup and is immovable, the overall size of the beverage container will be substantially enlarged. As a result, it is inconvenient to carry and store.

Therefore, there is a need for a beverage container with a foldable handle that allows the user to use the container conveniently when the foldable handle is unfolded and while allowing the beverage container to be stored easily with the foldable handle is folded. It is to the provision of such a beverage container with a foldable handle that the present disclosure is primarily directed.

SUMMARY OF THE PRESENT INVENTION

Certain variations of the present invention provide a beverage container with a foldable handle, wherein the foldable handle is locked at its folded position to reduce the overall size of the beverage container and is locked at its unfolded position to make the beverage container more convenient for carrying by hand.

In one aspect of the present invention, it provides a beverage container, comprising:

- a container body;
- a handle connector provided at an outer surface of the container body, wherein the handle connector has a first locking groove;
- a foldable handle pivotally coupled at the handle connector to pivotally move between a folded position and an unfolded position, wherein in the folded position, the foldable handle is folded flat on the cup body, and in the unfolded position, the foldable handle is outwardly extended from the cup body; and

- a locking assembly which comprises a locking button slidably coupled at the foldable handle between a locked position and an unlocked position, wherein the locking button comprises a locking latch extended toward the connector body to selectively engage with the first locking groove, wherein when the locking button is actuated to disengage the locking latch with the first locking groove, the foldable handle is unlocked and allowed to move between the folded position and the unfolded position, wherein when the locking button is actuated to engage the locking latch with the first locking groove, the foldable handle is locked at the unfolded position.

This summary presented above is provided merely to introduce certain concepts and not to identify any key or essential features of the claimed subject matter.

DETAILED DESCRIPTION OF THE PREFERRED EMBODIMENT

Figure 1:
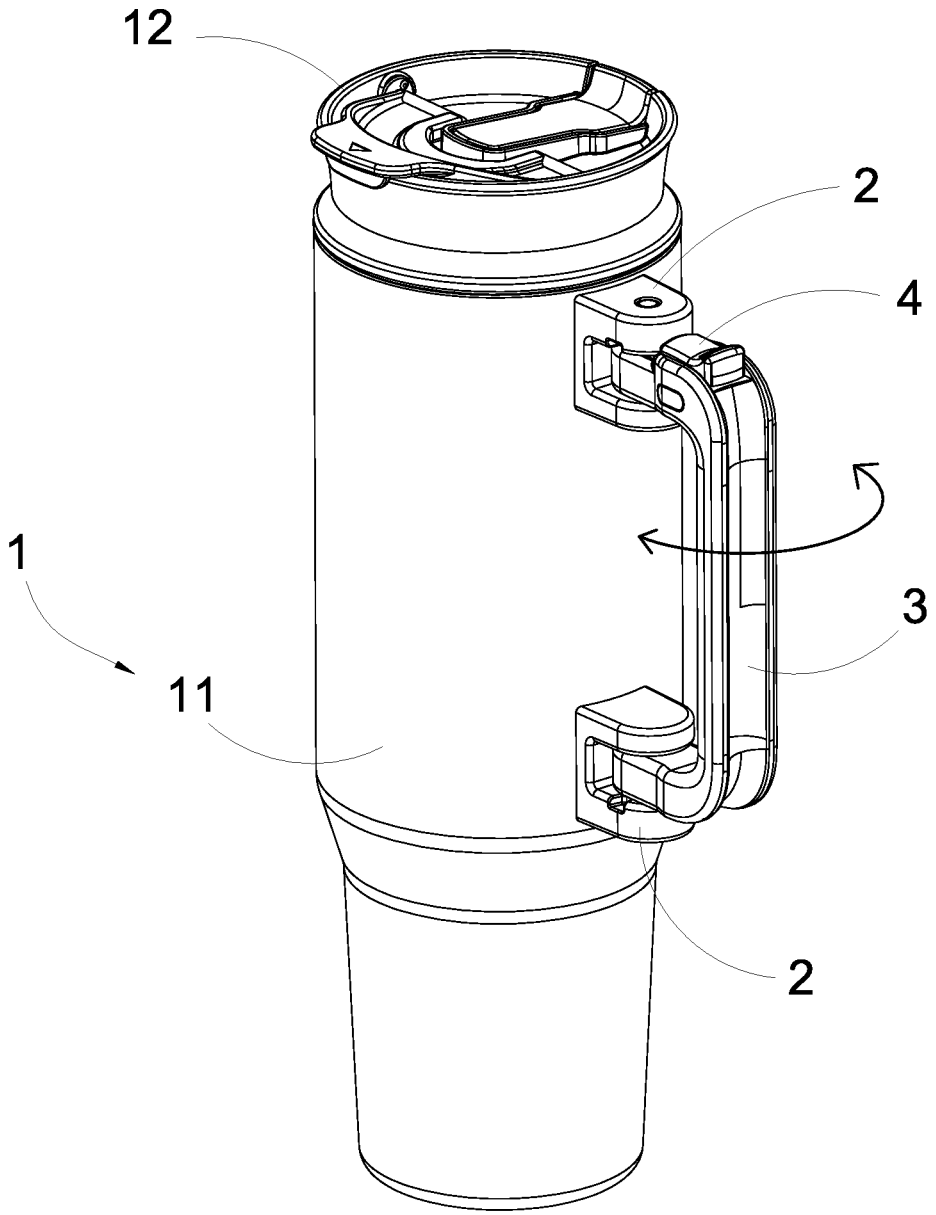
FIG. 1 is a perspective view of a beverage container with a foldable handle according to a preferred embodiment of the present invention.

The following detailed description of the preferred embodiment is the preferred mode of carrying out the invention. The description is not to be taken in any limiting sense. It is presented for the purpose of illustrating the general principles of the present invention.

In the following descriptions, it should also be appreciated that the terms "arrange" and "set" in the following description refer to the connecting relationship in the accompanying drawings for easy understanding of the present invention. For example, the "arrange" and "set" can refer to one element directly or indirectly set or arrange on another element. Therefore, the above terms should not be an actual connection limitation of the elements of the present invention.

It should also be appreciated that the terms "center", "length", "width", "thickness", "top", "bottom", "front", "rear", "left", "right", vertical", "horizontal", "upper", "lower", "interior", and "exterior" in the following description refer to the orientation or positioning relationship in the accompanying drawings for easy understanding of the present invention without limiting the actual location or orientation of the present invention. Therefore, the above terms should not be an actual location limitation of the elements of the present invention.

Moreover, it should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Therefore, the above terms should not be an actual connection limitation of the elements of the present invention.

Referring to FIGS. 1 to 11 of the drawings, a beverage container is illustrated, wherein the beverage container is embodied as a thermos cup as an example. Broadly, the beverage container may comprise a container body 1 having a beverage compartment, a handle connector 2 coupled at an outer surface of the container body 1, a foldable handle 3 movably coupled at the handle connector 2 to move between a folded position and an unfolded position, and a locking assembly 4 for releasably locking the foldable handle 3 at the unfolded position.

The container body 1 may comprise a cup body 11 having a thermal insulation ability as a thermos cup, wherein the container body 1 has an inner surface defining the cavity therein and a top opening communicating with the beverage compartment. A vacuum structure may be formed between the inner surface and the outer surface of the container body 1 to retain the beverage in the beverage compartment at a predetermined temperature for a period of time.

Figure 2:
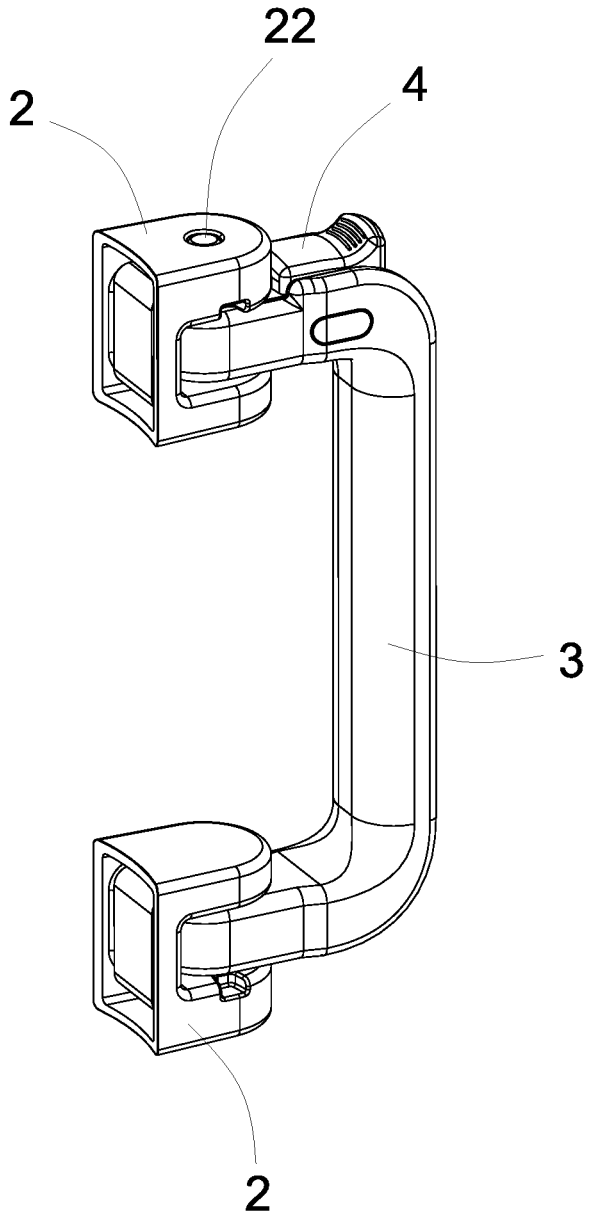
FIG. 2 is a perspective view of the foldable handle of the beverage container according to the preferred embodiment of the present invention.
Figure 3:
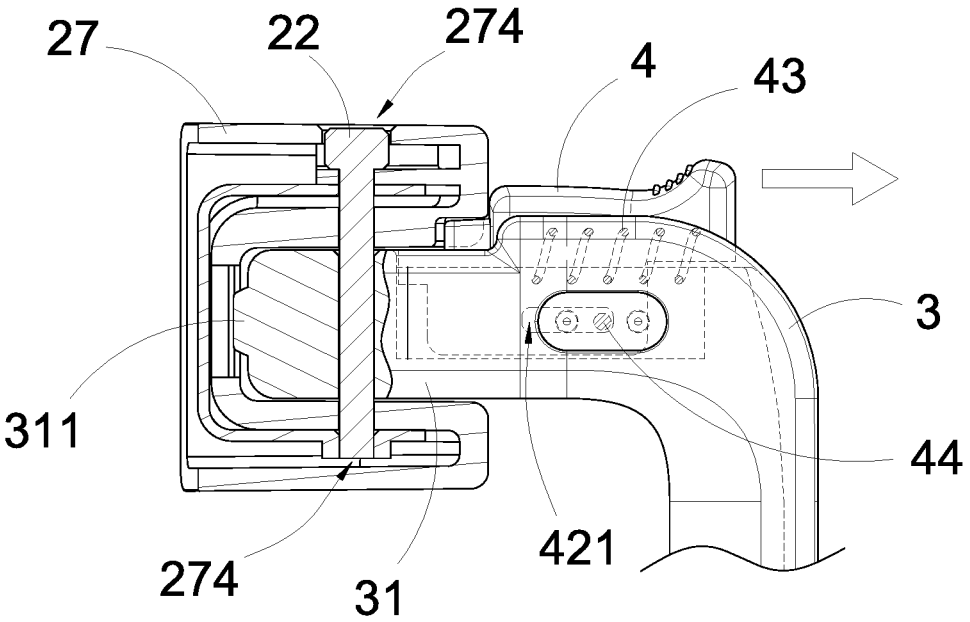
FIG. 3 is a partially sectional view of the foldable handle of the beverage container according to the preferred embodiment of the present invention.

The foldable handle 3 may outwardly and foldably extend from the outer surface of the container body 1 to move between the folded position and the unfolded position. In the preferred embodiment, as shown in FIG. 2, the foldable handle 3 may have a U-shaped configuration defining two folding free ends 31 and a handle portion 32 extended between the folding free ends 31, wherein the folding free ends 31 of the foldable handle 3 may be movably coupled at the outer surface of the container body 1 via two handle connectors 2 respectively. Therefore, when the foldable handle 3 is folded at the folded position, the handle portion 32 of the foldable handle 3 may be folded toward the outer surface of the container body 1, such that the foldable handle 3 may be folded flat on the container body 1 to minimize the overall of the beverage container. When the foldable handle 3 is folded at the unfolded position, the handle portion 32 of the foldable handle 3 may be folded away from the outer surface of the container body 1 to outwardly extend therefrom, such that the user may be able to hold the container body 1 via the foldable handle 3. In other words, the foldable handle 3 may be able to pivotally swing left or right as the folding movement to fold up the foldable handle 3. Alternatively, the foldable handle 3 may be configured to have a L-shaped configuration defining one folding free 31 end and a handle portion 32 extended from the folding free end 31, wherein the folding free end 31 of the foldable handle 3 may be movably coupled at the outer surface of the container body 1 via one handle connector 2. The folding movement of the L-shaped foldable handle 3 may be the same as that of the U-shaped foldable handle 3.

The handle connector 2 may be coupled at an upper portion of the container body 1 at the outer surface thereof to connect with the free end 31 of the foldable handle 3. As shown in FIGS. 2 to 5, the handle connector 2 may comprise a folding shaft 22, wherein the free end of the foldable handle 3 may be pivotally connected to the handle connector at the folding shaft 22, such that the foldable handle 3 may be pivotally coupled to the handle connector 2.

The locking assembly 4 may be movably coupled at the handle connector 2 to move between a locked position and an unlocked position. At the locked position of the locking assembly 4, the foldable handle 3 may be locked up with the handle connector 2 in an immovable manner so as to lock up the foldable handle 3 at the unfolded position. At the unlocked position of the locking assembly 4, the foldable handle 3 may be free to pivotally move with the handle connector 2, such that the foldable handle 3 may be able to move from the unfolded position to the folded position.

As shown in FIGS. 3 to 6, the handle connector 2 may have a folding cavity 21 and may comprise a connector body 27 for coupling the free end 31 of the foldable handle 3, and a supporting frame 23 received in the connector body 27.

The connector body 27 may have a U-shaped configuration and defining an upper member 271, a lower member 272, and a connecting member 273 extended between the upper member 271 and the lower member 272, wherein the folding cavity 21 may be formed between the upper member 271 and the lower member 272. The connector body 27 may further have two pivot slots 274 provided at the upper member 271 and the lower member 272 respectively, wherein upper and lower ends of the folding shaft 22 may be received at the pivot slots 274, such that the folding shaft 22 may extend between the upper member 271 and the lower member 272 and may be retained at the folding cavity 21.

Figure 5:
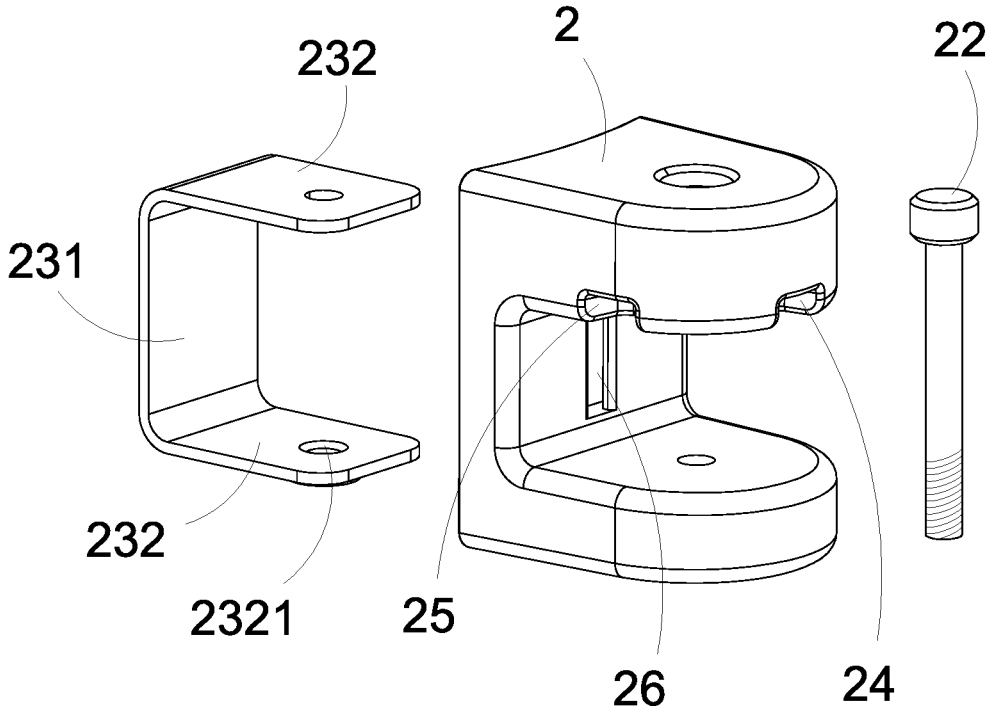
FIG. 5 is an exploded perspective view of the handle connector of the foldable handle according to the preferred embodiment of the present invention.

When the free end of the foldable handle 3 is pivotally coupled at the connector body 27 via the folding shaft 22, the foldable handle 3 may be pivotally moved between the folded position and the unfolded position. Preferably, the pivot slot 274 at the upper member 271 may be a through slot and the pivot slot 274 at the lower member 272 may be a non-through slot, such that the lower end of the folding shaft 22 may extend from the upper member 271 through the pivot slot 274 thereat and may be retained at the lower member 272 at the pivot slot 274 thereat. As shown in FIG. 5, the folding shaft 22 may have an enlarged head portion formed at the upper end and an elongated shaft body defining the lower end thereat. Therefore, a diameter of the pivot slot 274 at the upper member 271 may be larger than a diameter of the pivot slot 274 at the lower member 272.

The supporting frame 23 may have a corresponding U-shaped configuration, wherein the supporting frame 23 may comprise upper and lower supporting panels 232 receiving in the upper member 271 and the lower member 272 respectively and an extension panel 231 extending between the two supporting panels 232 to receive in the connecting member 273. Preferably, the two supporting panels 232 may be parallel with each other. In one embodiment, the supporting frame 23 may be made of rigid material such as metal and the connector body 27 is made of light weight but rigid material such as plastic. Therefore, when the supporting frame 23 is embedded or fitted in the connector body 27, the supporting frame 23 may be capable of reinforcing the strength of the connector body 27. Preferably, the supporting frame 23 may further have two reinforcing slots 2321 provided at the supporting panels 232 to coaxially algin with the pivot slots 274 of the connector body 27 when the supporting frame 23 may be received in the connector body 27, such that the folding shaft 22 may be arranged to pass through the reinforcing slots 2321 to couple at the connector body 27. In other words, the supporting frame 23 not only reinforces the structure of the connector body 27 but also reinforces the folding shaft 22.

Preferably, the folding shaft 22 may be a screw having a thread structure provided at the lower end. The reinforcing slot 2321 at the lower supporting panel 232 may be a screw slot, such that the folding shaft 22 may extend from the upper member 271 through the free end 31 of the foldable handle 3 to engage with the reinforcing slot 2321 at the lower supporting panel 232 so as to pivotally couple the free end 31 of the foldable handle 3 at the folding cavity 21 of the handle connector 2. It is worth mentioning that the folding shaft 22 may be non-rotating when folding the foldable handle 3. By configuring the folding shaft 22 as a screw, the screw not only serves as a rotating shaft, but also uses as a connecting member to provide the quick connection between the foldable handle 3 and the handle connector 2 with a simple structure and in low cost.

There are different connecting structures for securely coupling the handle connector 2 to the container body 1. In one example, if the outer surface of the container body 1 is made of plastic, the connector body 27 may be directly mounted to the outer surface of the container body 1. If the outer surface of the container body 1 is made of metal, the supporting frame 23 may be directly mounted to the outer surface of the container body 1 by welding, so as to mount the handle connector 2 to the container body 1.

The locking assembly 4 may comprise a locking button 41 slidably coupled on the free end of the foldable handle 3 and a locking latch 45 extending from the locking button 41 toward the connector body 27, wherein the handle connector 2 may have a first locking groove 24 and a second locking groove 25 spaced apart from the first locking groove 24, wherein the locking button 41 may slidably move to selectively engage with one of the first and second locking grooves 24, 25 so as to selectively lock up the foldable handle 3 between the folded and unfolded positions.

Particularly, the first and second locking grooves 24, 25 may spacedly form at a sidewall of the upper member 271 of the connector body 27. When the locking button 41 is slid on the free end 31 of the foldable handle 3 at a direction away from the container body 2, the locking latch 45 may disengage with any one of the first and second locking grooves 24, 25, such that the foldable handle 3 may be unlocked and is free to pivotally move between the folded position and the unfolded position.

When the foldable handle 3 is pivotally moved at the unfolded position, the locking button 41 is slid on the free end 31 of the foldable handle 3 at a direction toward the container body 2 to engage the locking latch 45 with the first locking groove 24, such that the foldable handle 3 may be locked at the unfolded position. Likewise, when the foldable handle 3 is pivotally moved at the folded position, the locking button 41 is slid on the free end 31 of the foldable handle 3 at a direction toward the container body 2 to engage the locking latch 45 with the second locking groove 25, such that the foldable handle 3 is locked at the folded position.

It should be appreciated that the locking latch 45 and the locking groove 24, 25 may form a tongue-groove engagement to lock up the foldable handle 3 between the folded and unfolded positions. Alternatively, the locking groove 24, 25 may be replaced by two locking latches while the locking latch 45 can be replaced by a locking groove, such that the locking groove at the locking button 41 may be selectively engaged with one of two locking latches at the handle connector so as to provide the tongue-groove engagement to lock up the foldable handle 3 between the folded and unfolded positions.

Furthermore, the handle connector 2 may further have a positioning slot 26 while the foldable handle 3 may further have a positioning protrusion 311 protruded from the free end 31 thereof, wherein the positioning protrusion 311 may engage with the positioning slot 26 when the foldable handle 3 is moved at the unfolded position. Therefore, the engagement between the positioning protrusion 311 and the positioning slot 26 may ensure the unfolded position of the foldable handle 3. In other words, once the positioning protrusion 311 is engaged with the positioning slot 26, the locking button 41 may be slid on the free end 31 of the foldable handle 3 at a direction toward the container body 2 to engage the locking latch 45 with the first locking groove 24, so as to lock up the foldable handle 3 at the unfolded position. Preferably, the free end 31 of the foldable handle 3 may have a round corner to enhance the free end 31 of the foldable handle 3 pivotally moving at the folding cavity 21 of the handle connector 2.

Figure 4:
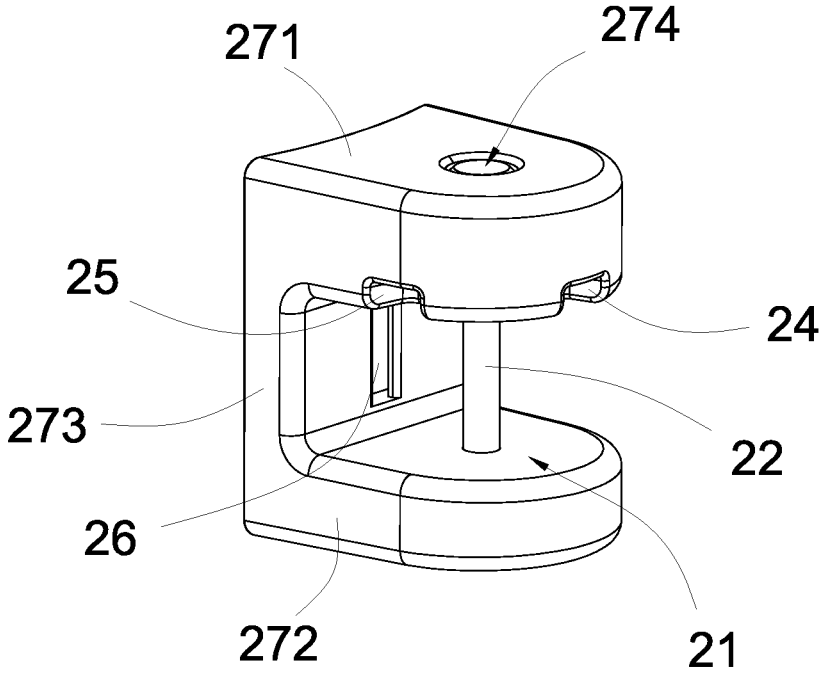
FIG. 4 is a perspective view of a handle connector of the foldable handle of the beverage container according to the preferred embodiment of the present invention.
Figure 6:
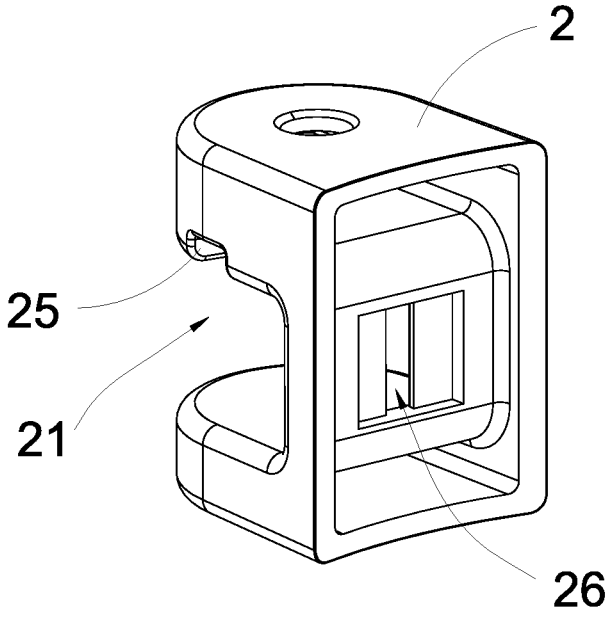
FIG. 6 is another perspective view of the handle connector of the foldable handle of the beverage container according to the preferred embodiment of the present invention.

As shown in FIGS. 4 to 6, the positioning slot 26 is a through slot formed at the connecting member 273 of the connector body 27. Moreover, two second locking grooves 25 may be provided at the upper member 271 of the connector body 27, wherein the first locking groove 25 may be positioned between the two second locking grooves 25, such that foldable handle 3 may be allowed to pivotally move two sideward directions at the folded position. It is worth mentioning that a displacement between the first and second locking grooves 24, 25 may allow the foldable handle 3 to fold at 90 degrees between the folded and unfolded positions.

Figure 7:
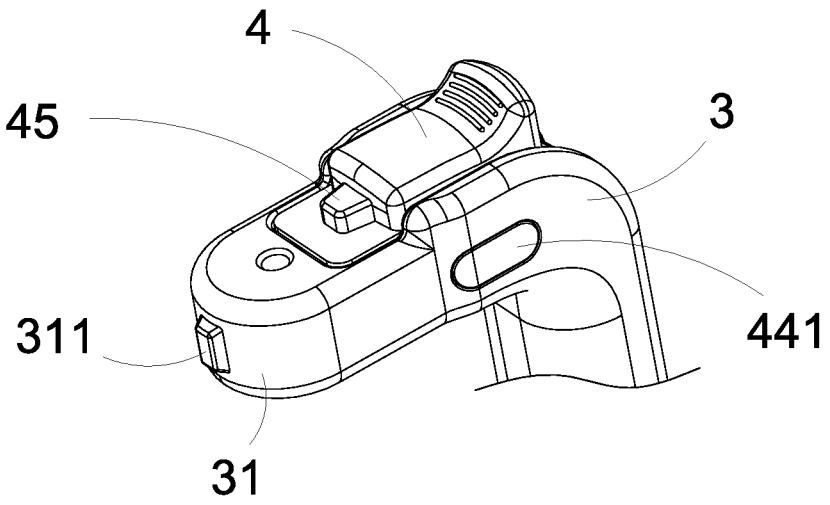
FIG. 7 is a perspective view of a locking assembly of the foldable handle of the beverage container according to the preferred embodiment of the present invention.
Figure 8:
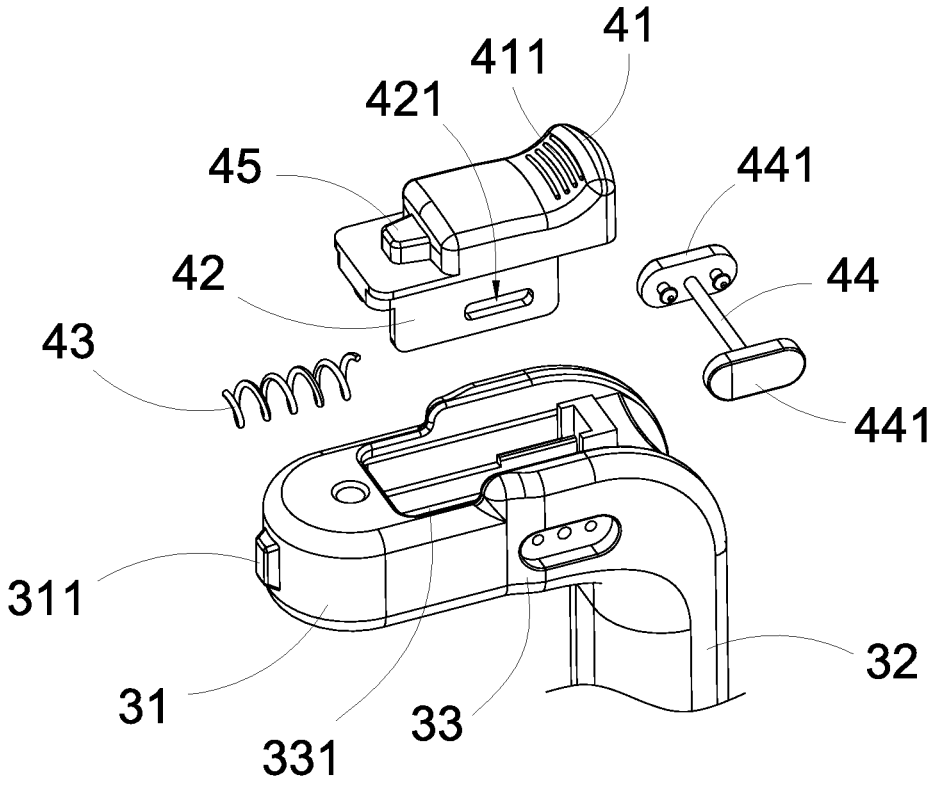
FIG. 8 is an exploded perspective view of the locking assembly of the foldable handle according to the preferred embodiment of the present invention.

As shown in FIGS. 1, 7 and 8, the foldable handle 3 may further have a connecting portion 33 extending from the handle portion 32 and defining the free end 31 at the connecting portion 33. Preferably, the connecting portion 33 may be perpendicular to the handle portion 32 and is pivotally coupled at the handle connector 2 via the folding shaft 22. In other words, the connecting portion 33 of the foldable handle 3 may be located between at the upper member 271 and the lower member 272 of the connector body 27. It should be appreciated that the U-shaped foldable handle 3 may have two connecting portions 33 extending from the handle portions 32 to pivotally couple with two handle connectors 2 on the outer surface of the container body 1.

As shown in FIG. 8, the foldable handle 3 may further have a sliding slot 331 provided on the connecting portion 33 of the foldable handle 3, wherein the locking button 41 may slidably engage with the sliding slot 311 to guide the locking button 41 being slid between the locked position and unlocked position. The sliding slot 331 may have a predetermined length adapted for the locking button 41 to slide from the locked position to the unlocked position. Accordingly, the locking button 41 may have a pusher portion upwardly extending from a top surface of the locking button 41 and an anti-slip pattern 411 provided on the pusher portion of the locking button 41, such that the user's thumb as an example may be able to press on the pusher portion of the locking button 41 to slide the locking button 41 between the locked position and the unlocked position.

The locking assembly 4 may further comprise two sliding guiders 42 downwardly and spacedly extended from the locking button 41 to slidably engage with the sliding slot 331, a resilient cavity formed between the sliding guiders 42, and a resilient element 43 disposed in the resilient cavity. A distance between the sliding guiders 42 may be slightly smaller than a width of the sliding slot 331, such that when the sliding guiders 42 are disposed in the sliding slot 331, the locking button 41 may stably slide between the locked position and the unlocked position.

The resilient element 43 may have an inner end held at an inner wall of the sliding slot 331 and an outer end held at an inner wall of the locking button 41, such that the resilient element 43 may be adapted to apply a resilient force to the locking button 41 to pull the locking button 41 toward the container body 1 so as to ensure the locking latch 45 being engaged with one of the first and second locking grooves 24, 25. Accordingly, the resilient element 43 may be a spring adapted to apply a spring force as the resilient force to pull the locking button 41. Particularly, when the user applies an outward sliding force on the pusher portion of the locking button 41 to overcome the resilient force of the resilient element 43, the locking button 41 may be moved from the locked position to the unlocked position. Once the sliding force on the locking button 41 is released, the resilient element 43 may automatically pull the locking button 41 back to the locked position from the unlocked position.

In order to further guide the sliding movement of the locking button 41, the locking assembly 4 may further comprise a guiding shaft 44 transversely extending in the sliding slot 331, wherein each of the sliding guiders 42 may have a guiding slot 421 extending parallel to the sliding slot 331. The guiding shaft 44 may slidably extend through the guiding slots 421 of the sliding guiders 42 to guide the sliding movement of the locking button 41. Two shaft holders 441 may be coupled at two ends of the guiding shaft 44 and may be coupled at two sidewalls of the sliding slot 331 respectively to retain the guiding shaft 44 within the sliding slot 331. In other words, the guiding shaft 44 may be immovably supported in the sliding slot 331 to guide the sliding movement of the locking button 41.

According to the preferred embodiment, the foldable handle 3 may be automatically locked up at the locked and unlocked positions via the resilient element 43. Particularly, the resilient force of the resilient element 43 may be applied to the locking button 41 to ensure the locking latch 45 engaged with one of the first and second locking grooves 25, such that the foldable handle 3 is locked at either the unfolded position or the folded position. Since the locking assembly 4 is built-in with the foldable handle 3, the overall size of the beverage container can be further reduced. When the foldable handle 3 is folded toward the container body 1 at the folded position, the overall size of the beverage container may be further reduced for convenient storage. At the unfolded position of the foldable handle 3, the foldable handle 3 may be securely locked via the locking assembly 4 to prevent any unwanted movement of the foldable handle 3 with respect to the container body 1. It should not be limited that other locking mechanisms can be employed in the preferred embodiment to lock and unlock the foldable handle 3.

Figure 9:
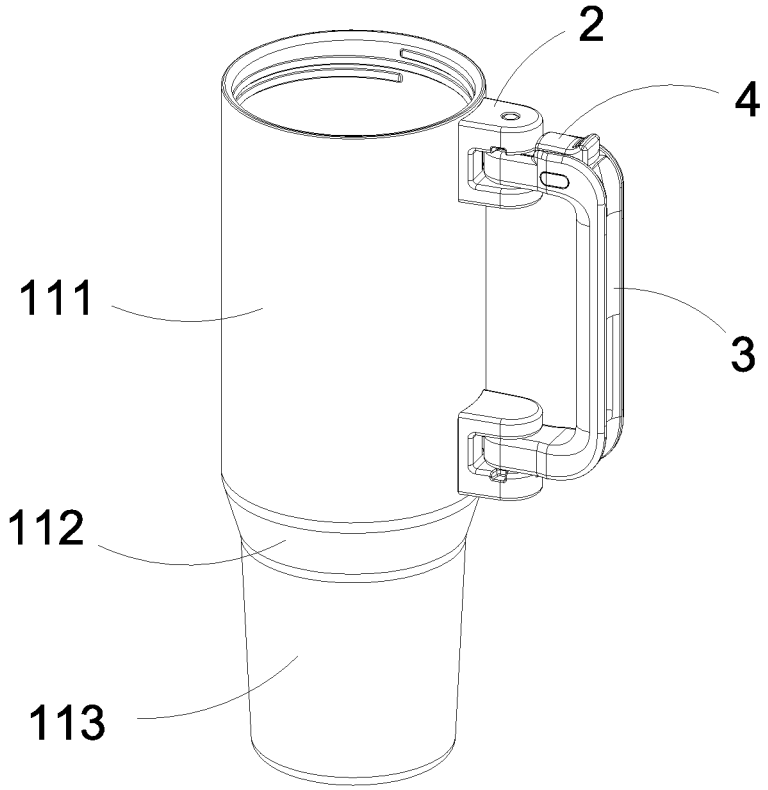
FIG. 9 is a perspective view of a container body of the beverage container according to the preferred embodiment of the present invention.
Figure 10:
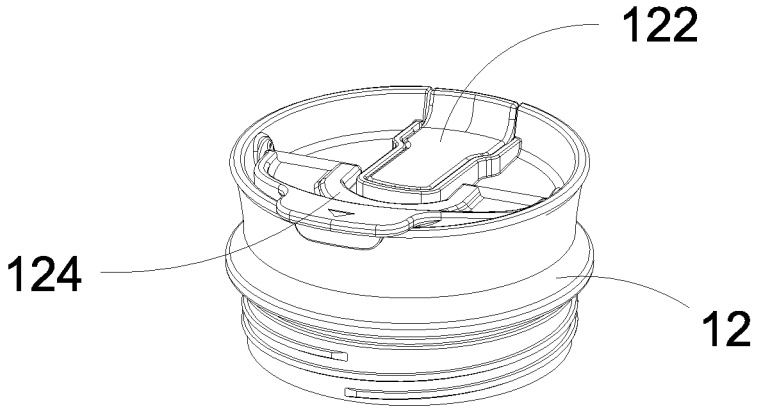
FIG. 10 is a perspective view of a container lid of the beverage container according to the preferred embodiment of the present invention.
Figure 11:
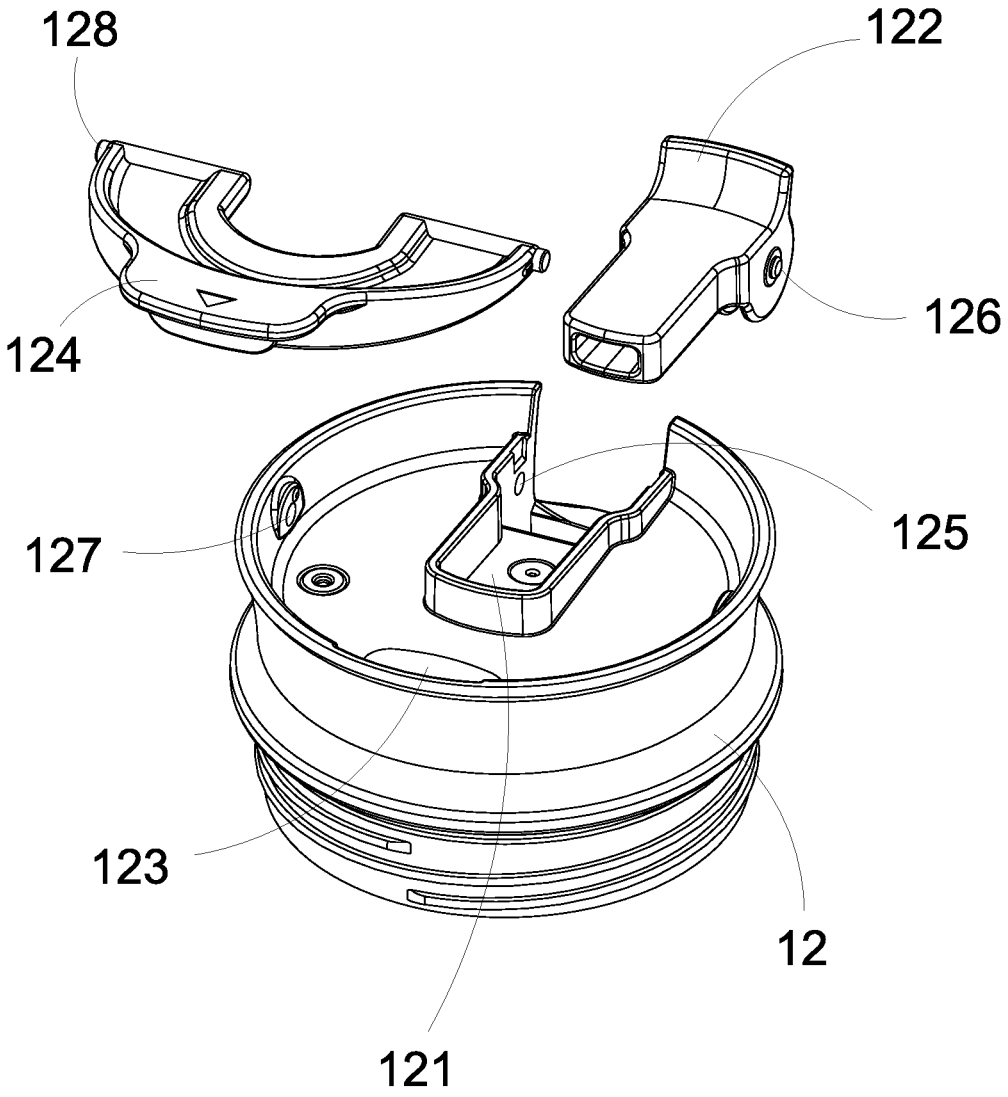
FIG. 11 is an exploded perspective view of the container lid of the foldable handle of the beverage container according to the preferred embodiment of the present invention.

As shown in FIGS. 9 to 11, the container body 1 may comprise a container lid 12 detachably coupled with the cup body 11 at the top opening thereof. In one embodiment, the container lid 12 may be detachably coupled with the cup body 11 via a threaded structure. Preferably, a sealing ring may be provided around the container lid 12 to seal at the inner surface of the cup body 11 to seal the beverage compartment when the container lid 12 is coupled with the cup body 11. The cup body 11 may have an upper cup portion 111, a mid cup portion 112, and a lower cup portion 113. The upper portion 111 of the cup body 11 may have a uniform diameter. The lower portion 113 of the cup body 11 may also have a uniform diameter. The diameter of the upper cup portion 111 may be larger than the diameter of the lower cup portion 113. A diameter of the mid cup portion 112 may gradually reduce from the upper cup portion 111 to the lower cup portion 113. The cup body 11 may have a double wall structure and a vacuum configuration within the double wall structure to provide the thermal insulation ability of the cup body 11.

The container lid 12 may have a dinking channel 121, a mouthpiece 122 pivotally coupled at the drinking channel 121, an operation button 123, and a lid cover 124. Accordingly, two first pivot holes 125 may be provided at two inner walls of the drinking channel 121, wherein two first pivot pins 126 may outwardly protrude from two outer sides of the mouthpiece 122 to engage with the first pivot holes 125 respectively, such that the mouthpiece 122 may be pivotally coupled at the drinking channel 121. Thus, via the pivot structure, the mouthpiece 122 may be able to be pivotally folded in the drinking channel 121 to protect and store the mouthpiece 122 and may be able to be pivotally folded out of the drinking channel 121 for usage. The operation button 123 may be actuated to pop up the mouthpiece 122 from the drinking channel 121, wherein a drinking straw is extended from the mouthpiece 122 into the drinking compartment. The straw may be made of soft and non-toxic material such as silicone.

Two second pivot holes 127 may be provided at two sidewalls of the container lid 12 while two second pivot pins 128 may outwardly protrude from two outer sides of the lid cover 124 to engage with the second pivot holes 127 respectively, such that the lid cover 124 may be pivotally coupled at the container lid 12. Accordingly, the lid cover 124 may be positioned between the mouthpiece and the operation button and may have a semicircular shape arranged to pivotally couple at the container lid 12 to selectively cover the operation button 123 or the mouthpiece 122. When the lid cover 124 is pivotally folded at one side of the container lid 12, the mouthpiece 122 may be covered by the lid cover 124. When the lid cover 124 is pivotally folded at another side of the container lid 12, the operation button 123 may be covered by the lid cover 124. Therefore, when the mouthpiece 122 is not in use, the mouthpiece 122 may be folded into the drinking channel 121 and covered by the lid cover 124 for hygiene purpose.

The present invention, while illustrated and described in terms of a preferred embodiment and several alternatives, is not limited to the particular description contained in this specification. Additional alternative or equivalent components could also be used to practice the present invention.

What is claimed is:

1. A beverage container, comprising:

a container body:

a handle connector provided at an outer surface of the container body, wherein the handle connector has a first locking groove;

a foldable handle pivotally coupled at the handle connector to pivotally move between a folded position and an unfolded position, wherein in the folded position, the foldable handle is folded flat on the container body, and in the unfolded position, the foldable handle is outwardly extended from the container body; and a locking assembly which comprises a locking button slidably coupled at the foldable handle between a locked position and an unlocked position, wherein the locking button comprises a locking latch extended toward the connector body to selectively engage with the first locking groove, wherein when the locking button is actuated to disengage the locking latch with the first locking groove, the foldable handle is unlocked and allowed to move between the folded position and the unfolded position, wherein when the locking button is actuated to engage the locking latch with the first locking groove, the foldable handle is locked at the unfolded position;

the handle connector comprising a connector body having a folding cavity, and a folding shaft supported in the folding cavity, wherein a free end of the foldable handle is received in the folding cavity of the connector body and is pivotally coupled with the folding shaft so as to enable the foldable handle to pivotally move between the folded position and the unfolded position;

the connector body comprising an upper member, a lower member, and a connecting member extended between the upper member and the lower member, wherein the folding cavity is formed between the upper member and the lower member to receive the free end of the foldable handle therebetween, wherein the folding shaft is extended from the upper member to lower member through the free end of the foldable handle, so as to pivotally couple the foldable handle with the connector body.

2. A beverage container, comprising:

a container body:

a handle connector provided at an outer surface of the container body, wherein the handle connector has a first locking groove;

a foldable handle pivotally coupled at the handle connector to pivotally move between a folded position and an unfolded position, wherein in the folded position, the foldable handle is folded flat on the container body, and in the unfolded position, the foldable handle is outwardly extended from the container body; and a locking assembly which comprises a locking button slidably coupled at the foldable handle between a locked position and an unlocked position, wherein the locking button comprises a locking latch extended toward the connector body to selectively engage with the first locking groove, wherein when the locking button is actuated to disengage the locking latch with the first locking groove, the foldable handle is unlocked and allowed to move between the folded position and the unfolded position, wherein when the locking button is actuated to engage the locking latch with the first locking groove, the foldable handle is locked at the unfolded position;

handle connector further having at least a second locking groove positioned away from the first locking groove, wherein when the locking button is actuated to disengage the locking latch with any one of the first and second locking grooves, the foldable handle is unlocked and allowed to move between the folded position, wherein when the locking button is actuated to engage the locking latch with the second locking groove, the foldable handle is locked at the folded position;

the handle connector further comprising a connector body having a folding cavity, and a folding shaft supported in the folding cavity, wherein a free end of the foldable handle is received in the folding cavity of the connector body and is pivotally coupled with the folding shaft so as to enable the foldable handle to pivotally move between the folded position and the unfolded position;

the connector body comprising an upper member, a lower member, and a connecting member extended between the upper member and the lower member, wherein the folding cavity is formed between the upper member and the lower member to receive the free end of the foldable handle therebetween, wherein the folding shaft is extended from the upper member to lower member through the free end of the foldable handle, so as to pivotally couple the foldable handle with the connector body.

3. The beverage container, as recited in claim 2, wherein the first locking groove and two of the second locking grooves are spacedly provided at the upper member of the connector body at a position that the first locking groove is located between the two second locking grooves.

4. The beverage container, as recited in claim 2, wherein the folding shaft is a screw, wherein a screw slot is provided at the lower member, such that the folding shaft is securely engaged with the screw slot to securely retain the folding shaft between the upper member and the lower member.

5. The beverage container, as recited in claim 2, wherein the handle connector further has a positioning slot provided at the connecting member, wherein the foldable handle further has a positioning protrusion protruded from the free end thereof, wherein the positioning protrusion is engaged with the positioning slot when the foldable handle is moved at the unfolded position.

6. The beverage container, as recited in claim 2, wherein the free end of the foldable handle has a round corner to enhance the free end of the foldable handle pivotally moving at the folding cavity of the handle connector between the folded position and the unfolded position.

7. The beverage container, as recited in claim 2, wherein the handle connector further comprises a supporting frame which is made of metal, wherein the supporting frame comprises upper and lower supporting panels receiving in the upper member and the lower member respectively and an extension panel extended between the two supporting panels to receive in the connecting member, such that the supporting frame not only reinforces a structure of the connector body but also reinforces the folding shaft.

8. A beverage container, comprising:

a container body;

a handle connector provided at an outer surface of the container body, wherein the handle connector has a first locking groove;

a foldable handle pivotally coupled at the handle connector to pivotally move between a folded position and an unfolded position, wherein in the folded position, the foldable handle is folded flat on the container body, and in the unfolded position, the foldable handle is outwardly extended from the container body; and a locking assembly which comprises a locking button slidably coupled at the foldable handle between a locked position and an unlocked position, wherein the locking button comprises a locking latch extended toward the connector body to selectively engage with the first locking groove, wherein when the locking button is actuated to disengage the locking latch with the first locking groove, the foldable handle is unlocked and allowed to move between the folded position and the unfolded position, wherein when the locking button is actuated to engage the locking latch with the first locking groove, the foldable handle is locked at the unfolded position;

the handle connector further having at least a second locking groove positioned away from the first locking groove, wherein when the locking button is actuated to disengage the locking latch with any one of the first and second locking grooves, the foldable handle is unlocked and allowed to move between the folded position, wherein when the locking button is actuated to engage the locking latch with the second locking groove, the foldable handle is locked at the folded position;

the foldable handle further having a sliding slot provided at a free end thereof, wherein the locking button is slidably engaged with the sliding slot to guide the locking button being slid between the locked position and unlocked position;

the locking assembly further comprising two sliding guiders downwardly and spacedly extended from the locking button to slidably engage with the sliding slot, a resilient cavity formed between the sliding guiders, and a resilient element disposed in the resilient cavity for applying a resilient force at the locking button so as to retain the locking button in the locked position.

9. The beverage container, as recited in claim 8, wherein the resilient element comprises a spring having an inner end held at an inner wall of the sliding slot and an outer end held at an inner wall of the locking button, such that the resilient element is adapted to apply a spring force to the locking button to pull the locking button toward the container body so as to ensure the locking latch being engaged with one of the first and second locking grooves.

10. The beverage container, as recited in claim 9, wherein the locking assembly further comprises a guiding shaft transversely extended in the sliding slot, wherein each of the sliding guiders has a guiding slot extended parallel to the sliding slot, wherein the guiding shaft is slidably extended through the guiding slots of the sliding guiders to guide a sliding movement of the locking button.

11. A beverage container, comprising:

a container body:

a handle connector provided at an outer surface of the container body, wherein the handle connector has a first locking groove;

a foldable handle pivotally coupled at the handle connector to pivotally move between a folded position and an unfolded position, wherein in the folded position, the foldable handle is folded flat on the container body, and in the unfolded position, the foldable handle is outwardly extended from the container body;

a locking assembly which comprises a locking button slidably coupled at the foldable handle between a locked position and an unlocked position, wherein the locking button comprises a locking latch extended toward the connector body to selectively engage with the first locking groove, wherein when the locking button is actuated to disengage the locking latch with the first locking groove, the foldable handle is unlocked and allowed to move between the folded position and the unfolded position, wherein when the locking button is actuated to engage the locking latch with the first locking groove, the foldable handle is locked at the unfolded position; and a container lid detachably coupled with the container body at the top opening thereof, wherein the container lid comprises a dinking channel, a mouthpiece pivotally coupled at the drinking channel, two first pivot holes provided at two inner walls of the drinking channel, and two first pivot pins outwardly protruded from two outer sides of the mouthpiece to engage with the first pivot holes respectively, such that the mouthpiece is pivotally coupled at the drinking channel.

12. The beverage container, as recited in claim 11, wherein the container lid further comprises an operation button provided thereon and arranged to be actuated to pop up the mouthpiece from the drinking channel.

13. The beverage container, as recited in claim 12, wherein the container lid further comprises a lid cover positioned between the mouthpiece and the operation button, two second pivot holes provided at two sidewalls of the container lid, and two second pivot pins outwardly protruded from two outer sides of the lid cover to engage with the second pivot holes respectively, such that the lid cover is pivotally coupled at the container lid to selectively cover one of the operation button and the mouthpiece.

* * * * *